US010364988B2

(12) United States Patent
Hawie et al.

(10) Patent No.: US 10,364,988 B2
(45) Date of Patent: Jul. 30, 2019

(54) FUEL NOZZLE

(71) Applicant: PRATT & WHITNEY CANADA CORP., Longueuil (CA)

(72) Inventors: Eduardo David Hawie, Woodbridge (CA); Nigel Davenport, Hillsburgh (CA); Yen-Wen Wang, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 92 days.

(21) Appl. No.: 15/788,092

(22) Filed: Oct. 19, 2017

(65) Prior Publication Data

US 2018/0058694 A1 Mar. 1, 2018

Related U.S. Application Data

(62) Division of application No. 14/494,872, filed on Sep. 24, 2014, now Pat. No. 9,822,980.

(51) Int. Cl.

| | |
|---|---|
| ***F23R 3/28*** | (2006.01) |
| ***F23D 11/10*** | (2006.01) |
| ***F23R 3/10*** | (2006.01) |

(52) U.S. Cl.

CPC ..... *F23R 3/28* (2013.01); *F23D 11/107* (2013.01); *F23R 3/10* (2013.01); *F23D 2900/11101* (2013.01)

(58) Field of Classification Search

CPC .... F23D 5/06; F23D 5/08; F23D 11/106–108; F23D 2900/11101; F23R 3/28; F23R 3/10; F23R 3/286; F23R 3/30; F23R 3/32

See application file for complete search history.

(56) References Cited

U.S. PATENT DOCUMENTS

| | | | | |
|---|---|---|---|---|
| 4,139,157 | A | 2/1979 | Simmons | |
| 5,813,847 | A | 9/1998 | Eroglu et al. | |
| 6,276,141 | B1 | 8/2001 | Pelletier | |
| 6,289,676 | B1 | 9/2001 | Prociw et al. | |
| 6,289,677 | B1 | 9/2001 | Prociw et al. | |
| 7,454,914 | B2 | 11/2008 | Prociw | |
| 7,766,251 | B2 | 8/2010 | Mao et al. | |
| 8,096,135 | B2 | 1/2012 | Caples | |
| 2005/0039456 | A1* | 2/2005 | Hayashi | F23D 11/107 60/737 |
| 2010/0300105 | A1* | 12/2010 | Pelletier | F23D 11/103 60/740 |
| 2011/0067403 | A1 | 3/2011 | Williams et al. | |
| 2012/0196234 | A1 | 8/2012 | Bulat et al. | |
| 2014/0090382 | A1 | 4/2014 | Sandelis et al. | |
| 2014/0090394 | A1 | 4/2014 | Low et al. | |

FOREIGN PATENT DOCUMENTS

| | | |
|---|---|---|
| EP | 0444811 | 9/1991 |

* cited by examiner

*Primary Examiner* — Andrew H Nguyen
(74) *Attorney, Agent, or Firm* — Norton Rose Fulbright Canada LLP

(57) ABSTRACT

A method for delivering fuel from a fuel nozzle of a combustor of a gas turbine engine includes directing fuel from a fuel source through a flow splitter to provide at least two concentric fuel flows, filming the concentric two fuel flows on concentrically arranged inwardly facing filming surfaces that are disposed downstream of the flow splitter, and atomizing the concentric fuel flows into a core air flow.

8 Claims, 5 Drawing Sheets

FUEL NOZZLE

CROSS-REFERENCE TO RELATED APPLICATION

The present application is a divisional of U.S. patent application Ser. No. 14/494,872 filed on Sep. 24, 2014, the entire content of which is incorporated herein by reference.

TECHNICAL FIELD

The application relates generally to gas turbines engines combustors and, more particularly, to fuel nozzles.

BACKGROUND

Gas turbine engine combustors employ a plurality of fuel nozzles to spray fuel into the combustion chamber of the gas turbine engine. The fuel nozzles atomize the fuel and mix it with the air to be combusted in the combustion chamber. The atomization of the fuel and air into finely dispersed particles occurs because the air and fuel are supplied to the nozzle under relatively high pressures. The fuel could be supplied with high pressure for pressure atomizer style or low pressure for air blast style nozzles providing a fine outputted mixture of the air and fuel may help to ensure a more efficient combustion of the mixture. Finer atomization provides better mixing and combustion results, and thus room for improvement exists.

SUMMARY

There is accordingly provided a method for delivering fuel from a fuel nozzle of a combustor of a gas turbine engine, the method comprising: directing fuel from a fuel source through a flow splitter to provide at least two concentric fuel flows, filming the at least two concentric two fuel flows on concentrically arranged inwardly facing filming surfaces disposed downstream of the flow splitter, and atomizing the at least two concentric fuel flows into a core air flow.

There is also provided a method for delivering fuel from a fuel nozzle of a combustor of a gas turbine engine, the method comprising: directing a core air flow through a primary air passage of the fuel nozzle, the primary air passage extending centrally within the fuel nozzle and terminating at an exit located at a downstream end of the fuel nozzle; directing fuel from a fuel source through a flow splitter to provide at least two concentric fuel flows, the flow splitter disposed downstream of the exit of the primary air passage; filming the at least two concentric two fuel flows on concentrically arranged and radially inwardly facing filming surfaces disposed downstream of the flow splitter; and atomizing the at least two concentric fuel flows into the core air flow exiting the primary air passage.

BRIEF DESCRIPTION OF THE DRAWINGS

Reference is now made to the accompanying figures in which.

DETAILED DESCRIPTION

Figure 1:
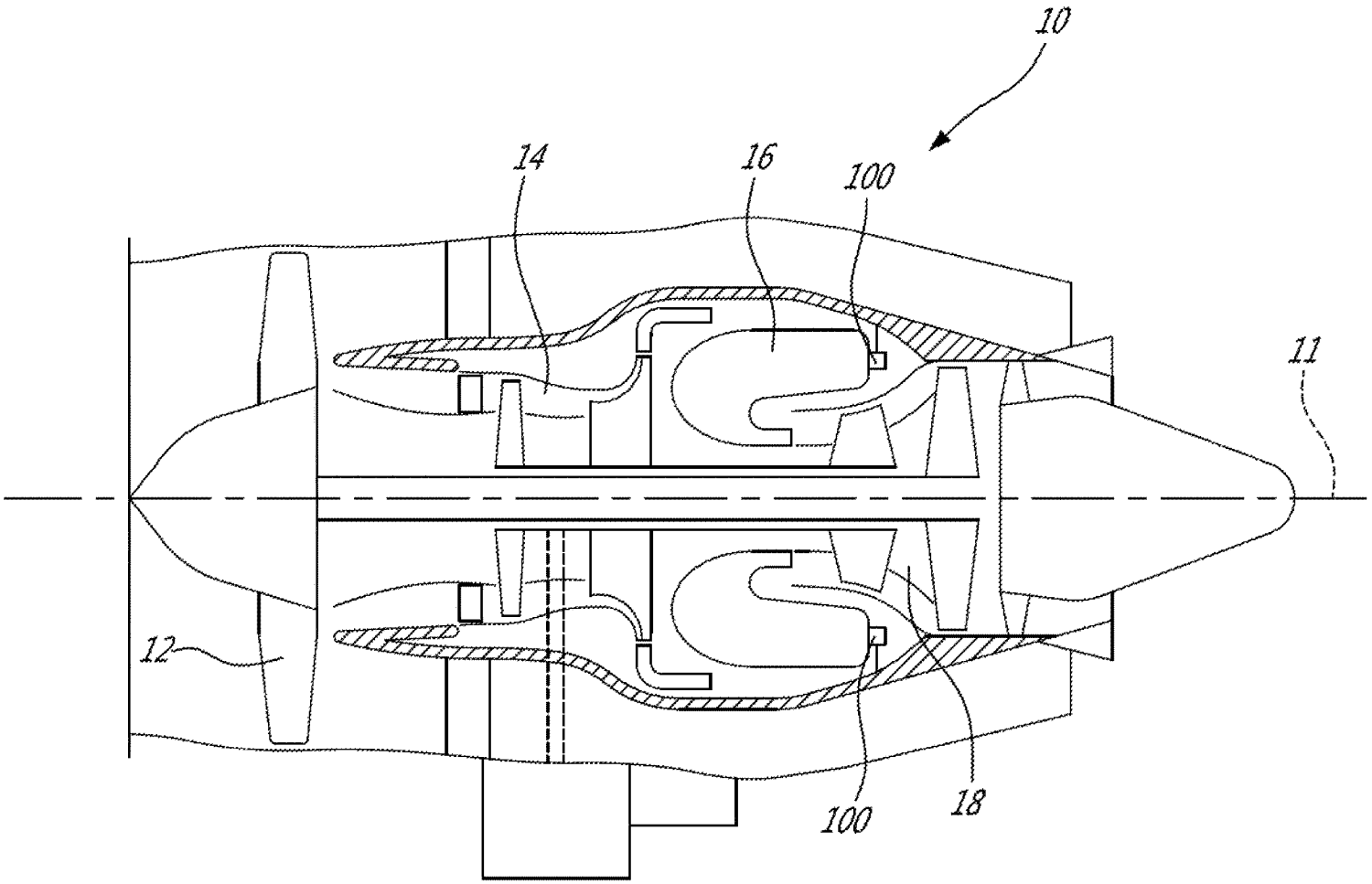
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The gas turbine engine 10 has one or more fuel nozzles 100 which supply the combustor 16 with the fuel which is combusted with the air in order to generate the hot combustion gases. The fuel nozzle 100 atomizes the fuel and mixes it with the air to be combusted in the combustor 16. The atomization of the fuel and air into finely dispersed particles occurs because the air and fuel are supplied to the nozzle 100 under relatively high pressures. The fuel could be supplied with high pressure for pressure atomizer style or low pressure for air blast style nozzles providing a fine outputted mixture of the air and fuel may help to ensure a more efficient combustion of the mixture. The nozzle 100 is generally made from a heat resistant metal or alloy because of its position within, or in proximity to, the combustor 16.

Figure 2:
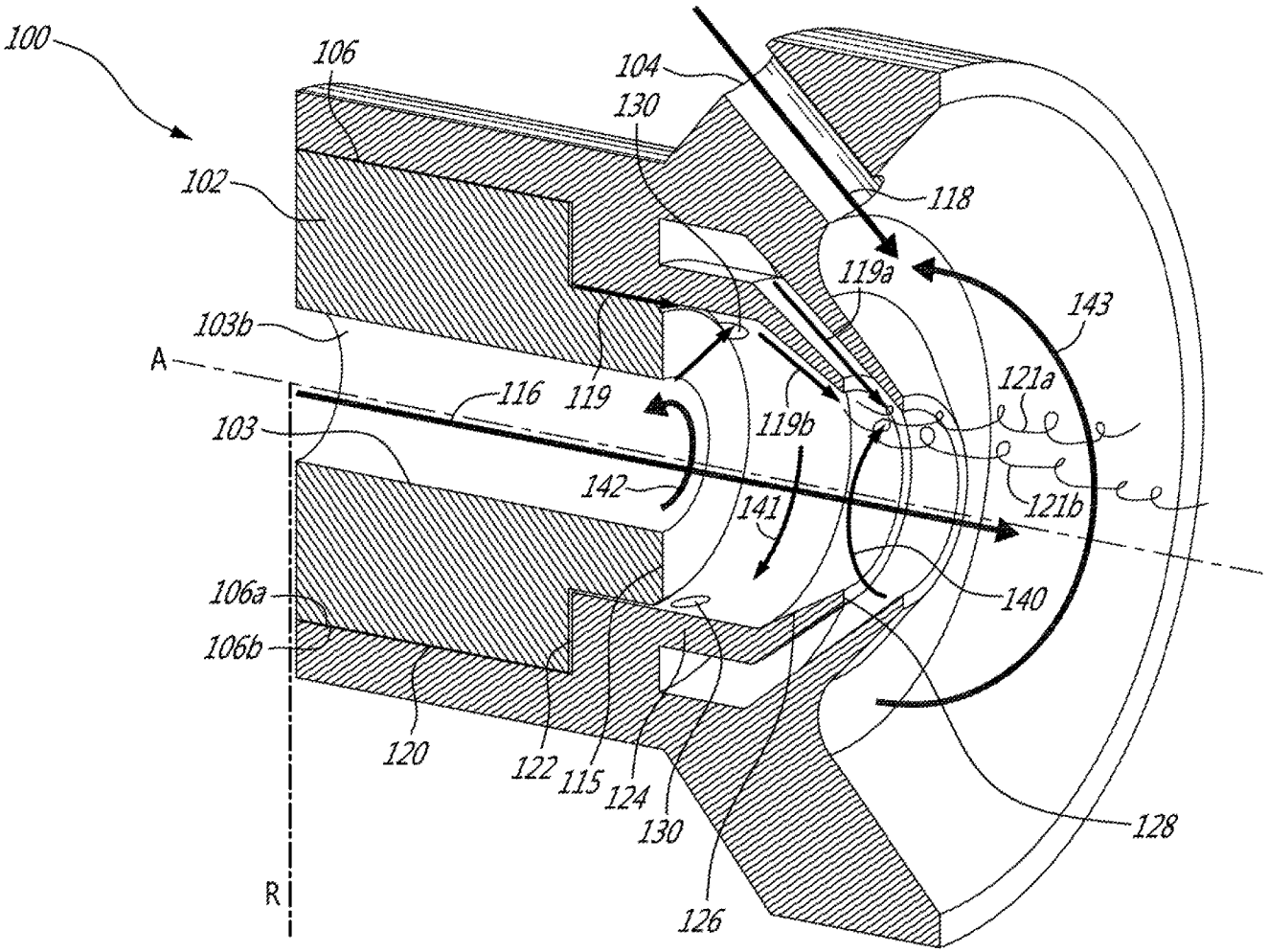
FIG. 2 is a partial schematic cross-sectional view of a first embodiment of a nozzle for a combustor of the gas turbine engine of FIG. 1.
Figure 3:
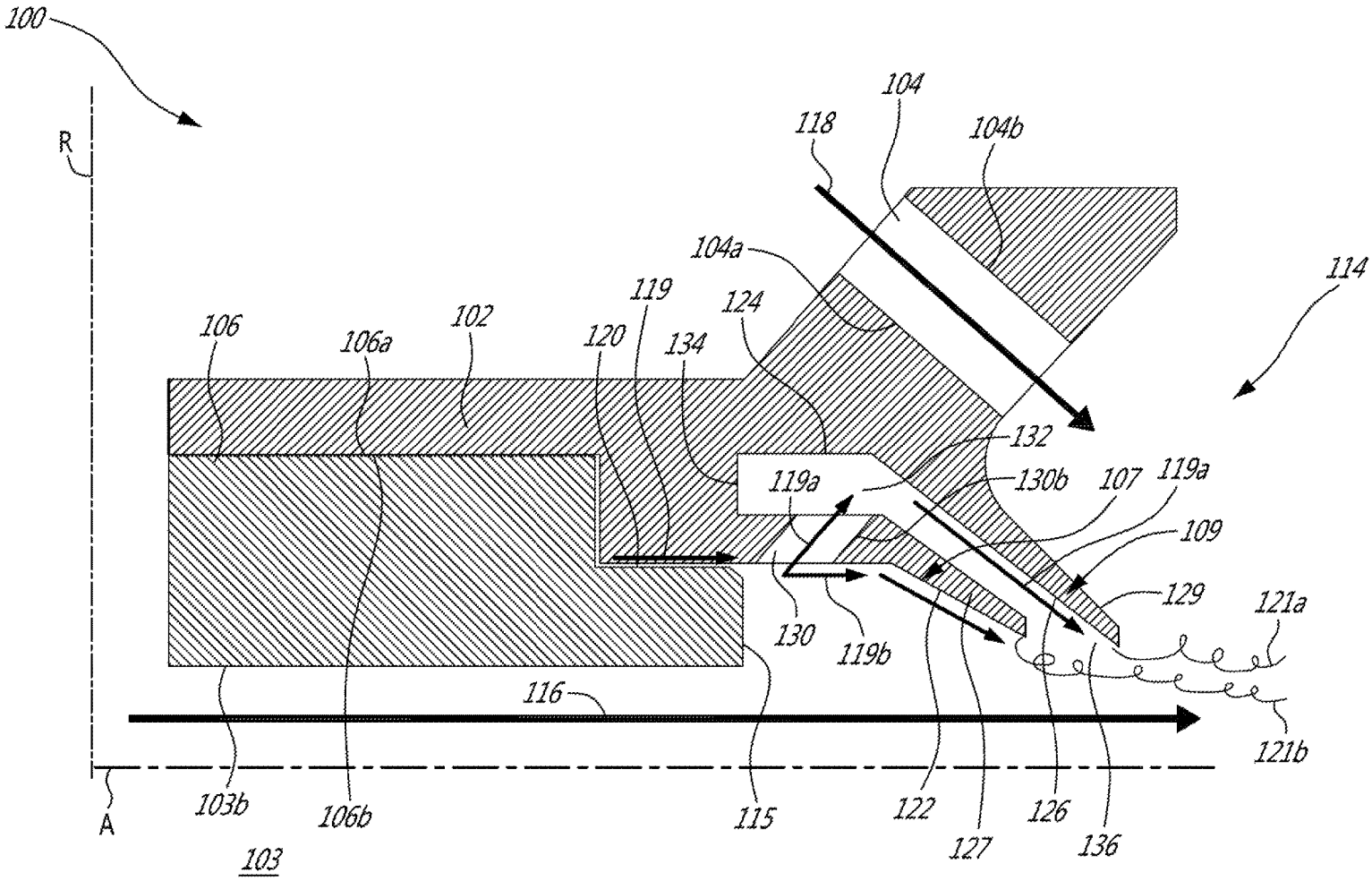
FIG. 3 is a partial view of the fuel nozzle of FIG. 2.

Turning now to FIGS. 2 and 3, a first embodiment of the fuel nozzle 100 will be described.

The nozzle 100 includes generally a cylindrical body 102 defining an axial direction A and a radial direction R. The body 102 is at least partially hollow and defines centrally in its interior a primary air passageway 103 (a.k.a. core air), a secondary air passageway 104 and a first fuel passageway 106, all extending axially through the body 102 and communicating with a pressurized source of fuel (not shown). The first fuel passageway 106 is disposed concentrically between the primary air passageway 103 and the secondary air passageway 104. The secondary air passageway 104 and the first fuel passageway 106 may be annular. As will be described in more detail below, the fuel passageway includes a plurality of concentric fuel flows which are fed to a plurality of frustoconical fuel filming surfaces 107 and 109.

Although the nozzle of FIGS. 2-3 is exemplary, it is contemplated that variations may be provided, such as, the nozzle 100 could include more than primary and secondary air passageways 103, 104, and/or that the primary and secondary air passageways 103, 104 could have any suitable configuration, such as a conduit, channel or an opening. The size, shape, and number of the air passageways 103, 104 may vary depending on the flow requirements of the nozzle 100, among other factors. Similarly, although one annular fuel passageway 106 is disclosed herein, it is contemplated that the nozzle 100 could include a plurality of fuel passageways 106, annular shaped or not. Alternately, rather than an air blast nozzle as shown, the present teachings may straightforwardly be applied to a pressure atomizer type nozzle—that is one which lacks the outer air flow provided by the secondary air passage in the air blast type.

The body 102 includes an upstream portion (not shown) connected to sources of pressurised fuel and air and a downstream portion 114 at which the air and fuel exit. The terms "upstream" and "downstream" refer to the direction along which fuel flows through the body 102. Therefore, the upstream end of the body 102 corresponds to the portion where fuel/air enters the body 102, and the downstream portion 114 corresponds to the portion of the body 102 where fuel/air exits.

The primary air passageway 103 is defined by outer wall 103*b*. The primary air passageway 103 carries pressurised air illustrated by arrow 116. The air 116 will be referred interchangeably herein to as "air", "jet of air", or "core flow of air". In the illustrated embodiment, the primary air passageway 103 is straight and the outer wall 103*b* does not have surface treatment at the downstream portion 114. It is however contemplated that the primary air passageway 103 could have various shapes and that the outer wall 103*b* could have surface treatment to induce spinning of the air 116 carried therethrough. The outer wall 103*b* ends at exit end 115.

The secondary air passageway 104 is annular and defined by inner wall 104*a* and outer wall 104*b* (only a downstream portion being shown in the Figures). The secondary air passageway 104 carries pressurised air illustrated by arrow 118. The air 118 will be referred interchangeably herein to as "air", or "film of air". The secondary air passageway 104 is disposed radially outwardly from the primary air passageway 103. The secondary air passageway 104 converges (i.e. cross-sectional area may decrease along its length, from inlet to outlet) at the downstream portion 114.

The first fuel passageway 106 is defined by inner wall 106*a* and outer wall 106*b*. The first fuel passageway 106 carries pressurised fuel illustrated by arrow 119. The fuel 119 will be referred interchangeably herein to as "fuel", or "fuel film". The inner wall 106*a* ends with the exit end 115 of the primary air passageway 103, while the outer wall 106*b* extends downstream relative to the inner wall 106*a*. The outer wall 106*b* provides a first filming surface 107, which includes an axial first portion 120 and a converging second portion 122, and a second filming surface 109, which includes an axial third portion 124 and a converging fourth portion 126. The first and second filming surfaces 107, 109 are inwardly (an in this example radially) facing surfaces of nozzle projections 127, 129. The nozzle projections 127, 129 are downstream extending portions of the outer walls of the first fuel passageway 106 and an annular second fuel passageway 132 disposed around the first fuel passageway 106.

The inner wall 106*a* and outer wall 106*b* are evenly spaced throughout the first fuel passageway 106 in this example. In the illustrated embodiment, the exit end 115 of the primary air passageway 103 ends axially at about the third portion 124, but it is contemplated that the exit end 115 could end elsewhere relative to the outer wall 106*b*. The fourth portion 126 ends at exit end 128, downstream of the exit end 115 of the air passageway 103.

The secondary air passageway 104 and the first fuel passageway 106 are typically convergent in the downstream direction at the downstream portion 114. The outer wall 106*b* of the first fuel passageway 106 is converging at the downstream portion 114, thereby forcing the annular fuel film 119 expelled by the first fuel passageway 106 onto the jet of air 116 expelled from the primary air passageway 103. Similarly, the outer wall 104*b* of the secondary air passageway 104 are converging at the downstream portion 114, thereby forcing the annular film of air 118 expelled by the secondary air passageway 104 onto the annular fuel film 119. At the downstream portion 114, the annular fuel film 119 is sandwiched by the core flow of air 116 of the primary air passageway 103 and the annular film of air 118 of the secondary air passageway 104.

In this example, the outer wall 106*b* of the first fuel passageway 106 includes a flow splitter, in the shape of a plurality of bifurcating passages 130 (only one being shown in FIG. 3) defined in the fuel nozzle body 102, in this example in the axial first portion 120. The bifurcating passages 130 connect to the annular second fuel passageway 132 disposed around a downstream portion of the first fuel passageway 106, and act as bifurcations of a portion 119*a* of the fuel 119, while a remaining portion 119*b* of the fuel continues to flow downstream the first fuel passageway 106. The bifurcating passages 130 are discrete cylindrical openings disposed in a circumferential array. The bifurcating passages 130 are disposed equidistant from each other to enable an equal circumferential repartition of the fuel 119*a*. It is contemplated that the bifurcating passages 130 could be omitted or could be positioned more upstream.

The second fuel passageway 132 includes a closed end 134 slightly upstream of the bifurcating passage 130 and an open end 136 (i.e. exit end) downstream of the bifurcating passage 130. An outer wall of the second fluid passageway 132 includes the second filming surface 109. It is contemplated that the closed end 134 could be adjacent to the bifurcating passages 130. The second fuel passageway 132 in this example is not connected to a pressurized source of fuel except by the first fuel passageway 106 and is fed in fuel solely by the first fuel passageway 106. The plurality of bifurcating passages 130 are the sole inlet of the second fuel passageway 132 in this example. As a result, the fuel film 119 splits into two concentric annular fuel films 119*a*, 119*b*, each of reduced thickness relative to the fuel film 119. Having a fuel film of reduced thickness tends to improve transformation of the fuel film into droplet (i.e. atomisation). In the example shown in the figures, the fuel film 119*b* exits the fuel nozzle 100 at the exit end 128 and becomes in contact with the air 116. Similarly the fuel film 119*a* becomes in contact with the air 118 at the open end 136. Shearing between the fuel films 119*a* (resp. 119*b*) and the air 118 (resp. 116) exiting at different velocities, creates respective droplets of fuel 121*a* (resp. 121*b*) that will be ignited in the combustor 16.

In use, the air 116, 118 and the fuel films 119*a*, 119*b* may be given a spin or swirl or momentum to increase shearing between them, but also to enable the portion 119*a* of the fuel film 119 to travel through the bifurcating passages 130. This spin or swirl may be achieved by any suitable means (not shown). When spinning in the first fuel passageway 106, the fuel film 119 has a tangential velocity component (or momentum) and tends to accumulate on the outer wall 106*b* of the first fuel passageway 106. As a result, when the fuel 119 encounters the bifurcating passage 130 formed in the outer wall 106*b*, a portion separates from the fuel film 119 and flows through the bifurcating passage 130 to provide a plurality of concentric fuel film flows 119*a*, 119*b*. These concentric fuel film flows 119*a* and 119*b* spinningly converge inwardly, as a result of being directed by the converging portions of the fuel filming surfaces 107, 109 (i.e. converging second portion 122, converging fourth portion 126), and disperse into atomized droplets 121*a*, 121*b*, as the fuel flows come into contact with the air flows 116, 118 passing through the respective primary and secondary air passageways 103, 104. Providing a plurality of concentric filming surfaces 107, 109 may result in a smaller droplet size, and hence better atomization, as compared to the provision of a single filming flow.

In the example shown in the figures, the plurality of bifurcating passages 130 are inclined relative to the radial direction R to facilitate the flow of the fuel 119*a*. An angle between a downstream wall 130*b* of the bifurcating passages 130 and the axial direction is acute (i.e. the bifurcating passages 130 are inclined downstream). It is however contemplated that the plurality of bifurcating passages 130 could be inclined in any suitable fashion, including possibly not inclined at all. For example, the bifurcating passages 130 could be aligned with the radial direction.

In the example shown in the Figures, the fuel film 119*a* is spinning in a clockwise direction 140, and the fuel film 119*b* is spinning in the same (i.e. clockwise) direction 141. The air 116 is spinning in a counter clockwise direction 142, and the air 118 is also spinning in the same (i.e. counter clockwise) direction 143. It is contemplated that the air 116, 118 and fuel films 119*a*, 119*b* may be spinning in various combinations of directions relative to each other, with the fuel films 119*a* and 119*b* spinning in a same direction. The tangential momentum of the fuel films 119*a*, 119*b* is initiated downstream of the bifurcating passages 130. Having opposite direction between the fuel films 119*a*, 119*b* may decrease the momentum and the velocity and possibly preventing the thinning of the fuel film. One of the air 112 and 188 could spin in a same direction as the fuel films 119*a*, 119*b*. Some of the fuel and air may also not be spinning.

Figure 4:
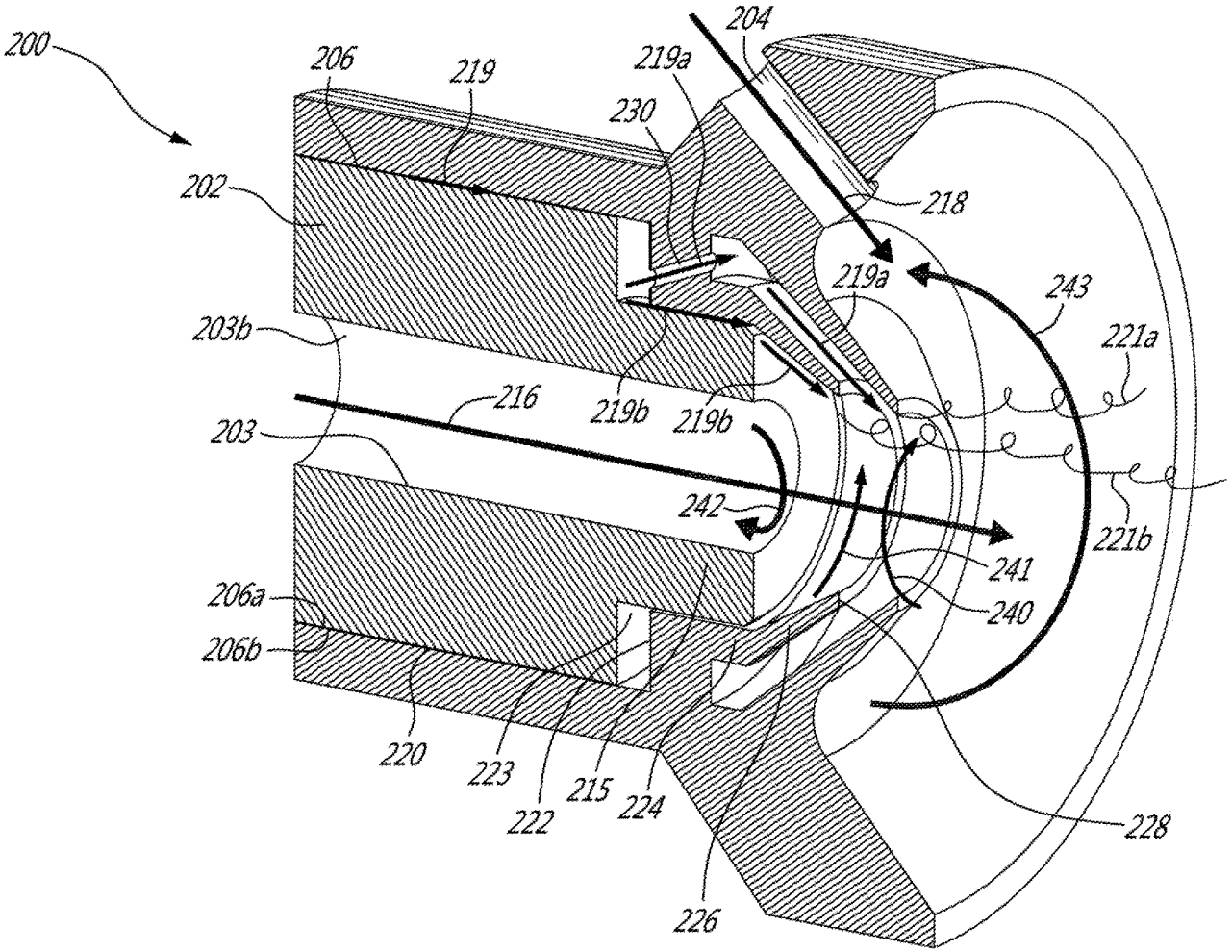
FIG. 4 is a partial schematic cross-sectional view of a second embodiment of a nozzle for a combustor of the gas turbine engine of FIG. 1.
Figure 5:
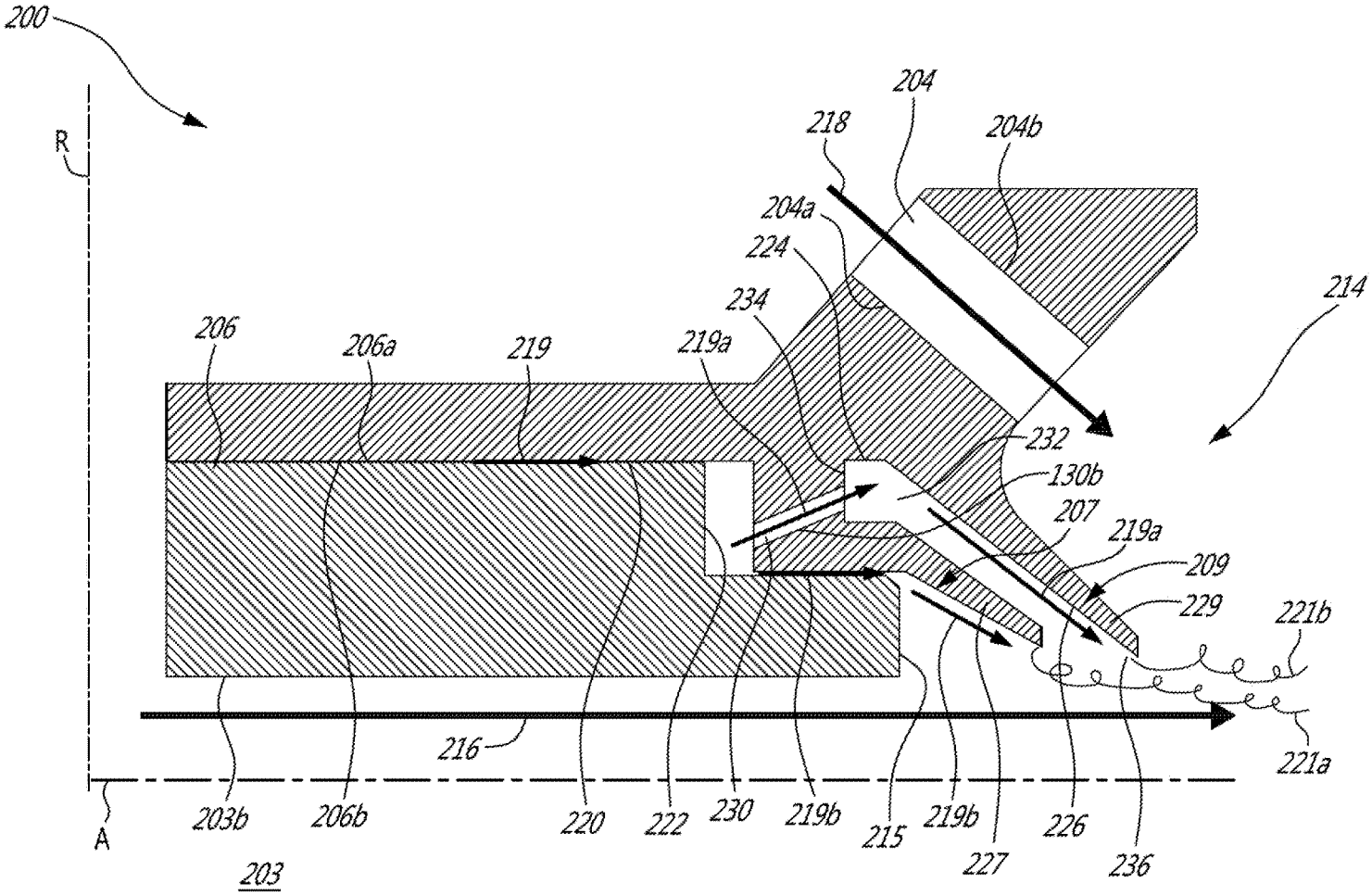
FIG. 5 is a partial view of the fuel nozzle of FIG. 4.

Turning now to FIGS. 4 and 5, a second embodiment of the fuel nozzle 200 will be described. The nozzle 200 has similarities with the nozzle 100, and common elements are provided with reference numbers incremented by 100 versus the previous example. A full description will not be repeated in great detail, again, except where relevant differences exist.

The nozzle 200 includes generally a cylindrical body 202 defining an axial direction A and a radial direction R. The body 202 defines centrally in its interior a primary air passageway 203 (a.k.a. core air), a secondary air passageway 204 and a first fuel passageway 206, all extending axially through the body 202 and communicating with a pressurized source of fuel (not shown). The first fuel passageway 206 is disposed concentrically between the primary air passageway 203 and the secondary air passageway 204. It is contemplated that the nozzle 200 could include more than one primary and secondary air passageways 203, 204 and that the primary and secondary air passageways 203, 204 could have a shape of any one of a conduit, channel and an opening. The size, shape, and number of the air passageways 203, 204 may vary depending on the flow requirements of the nozzle 200, among other factors. Similarly, although one annular first fuel passageway 206 is disclosed herein, it is contemplated that the nozzle 100 could include a plurality of fuel passageways 206, annular shaped or not. As will be described in more detail below, the fuel passageway includes a plurality of concentric fuel flows which are fed to a plurality of frustoconical fuel filming surfaces 207 and 209.

The body 202 includes an upstream end (not shown) connected to sources of pressurised fuel and air and a downstream end 214 at which the air and fuel exit. The terms "upstream" and "downstream" refer to the direction along which fuel flows through the body 202. Therefore, the upstream end of the body 202 corresponds to the portion where fuel/air enters the body 202, and the downstream end 214 corresponds to the portion of the body 202 where fuel/air exits.

The primary air passageway 203 is defined by outer wall 203*b* and carries pressurised air illustrated by arrow 216. The air 216 will be referred interchangeably herein to as "air", "jet of air", or "core flow of air". The secondary air passageway 104 is defined by inner wall 204*a* and outer wall 204*b* and carries pressurised air illustrated by arrow 218. The air 218 will be referred interchangeably herein to as "air", "film of air", or "flow of air".

The first fuel passageway 206 is defined by inner wall 206*a* and outer wall 206*b*, and carries pressurised fuel illustrated by arrow 219. The inner wall 206*a* ends with the exit end 215 of the primary air passageway 203, while the outer wall 206*b* extends downstream relative to the inner wall 206*a*. The outer wall 206*b* provides a filming surface 207 which includes an axial first portion 220, a converging second portion 222, and a second filing surface 209 which includes an axial third portion 224 and a converging fourth portion 226. The first and second filming surfaces 207, 209 are inwardly (an in this example radially) facing surfaces of nozzle projections 227, 229. The nozzle projections 227, 229 are downstream extending portions of the outer walls of the first fuel passageway 206 and an annular second fuel passageway 232 disposed around the first fuel passageway 206.

In this example, the inner wall 206*a* and outer wall 206*b* are evenly spaced throughout the first fuel passageway 206, except at the second portion 222, where the inner wall 206*a* and outer wall 206*b* form an annular chamber 223. The annular chamber 223 may allow the fuel to be fed from a single source. The size of the annular chamber 223 may vary from shown in the Figures. The fourth portion 226 ends at exit end 228, downstream of the exit end 215 of the air passageway 203.

The secondary air passageway 204 and the first fuel passageway 206 are typically convergent in the downstream direction at the downstream end 214. The outer wall 206*b* of the first fuel passageway 206 is converging at the downstream end 214, thereby forcing the annular film of fuel 219 expelled by the first fuel passageway 206 onto the jet of air 216 expelled from the primary air passageway 203. Similarly, the outer wall 204*b* of the secondary air passageway 204 is converging at the downstream end 214, thereby forcing the annular film of air 218 expelled by the secondary air passageway 204 onto the annular film of fuel 219. At the downstream end 214, the annular film of fuel 219 is sandwiched by the core flow of air 216 of the primary air passageway 103 and the annular flow of air 218 of the secondary air passageway 204.

In this example, the outer wall 206*b* of the first fuel passage 206 includes a flow splitter in the form of a plurality of bifurcating passages 230 (only one being shown in FIG. 5) defined in the second portion 222. The bifurcating passages 230 connect to the annular second fuel passageway 232 disposed around a downstream portion of the first fuel passageway 206, and act as bifurcations of a portion 219*a* of the fuel 219, while a remaining portion 219*b* of the fuel continues to flow downstream the first fuel passageway 206. In this example, the bifurcating passages 230 are the sole inlet of the second fuel passageway 232. The bifurcating passages 230 are discrete cylindrical openings disposed in a single circumferential array. The bifurcating passages 230 are disposed equidistant from each other to enable an equal circumferential repartition of the fuel 219*a*. It is contemplated that the bifurcating passages 230 could be omitted or could be positioned more upstream.

The second fuel passageway 232 includes an end 234 connected to the bifurcating passage 230 and an open end 236 downstream of the bifurcating passage 230. An outer wall of the second fluid passageway 232 includes the filming surface 209. The second fuel passageway 232 is not connected to a source of fuel and is fed in fuel solely by the first fuel passageway 206. As a result, the fuel film 219 splits into two concentric annular fuel films 219*a*, 219*b*, each of reduced thickness relative to the fuel film 219. Having a fuel film of reduced thickness improves transformation of the fuel film into droplet (i.e. atomisation). In the example shown in the figures, the fuel film 219*b* exits the fuel nozzle 200 at the exit end 228 and becomes in contact with the air 216. Similarly the fuel film 219*a* becomes in contact with the air 218 at the open end 136. Shearing between the fuel films 219*a* (resp. 219*b*) and the air 218 (resp. 216) exiting at different velocities, creates respective droplets 221*a* (resp. 221*b*) of fuel that will be ignited in the combustor 16.

In use, the air 216, 218 and the fuel films 219*a*, 219*b* may be given a spin or swirl or momentum to increase shearing between them, but also to enable the portion 219*a* of the fuel film 219 to travel through the bifurcating passages 230. This spin or swirl may be achieved by any suitable means. The surface treatment may include a plurality of grooves, for example, helicoidally grooves or protrusions. When spinning in the first fuel passageway 206, the fuel film 219 has a tangential velocity component (or momentum) and tends to accumulate on the outer wall 206*b* of the fuel passageways 206. As a result, when the fuel 219 encounters the bifurcating passage 230 formed in the outer wall 206*b*, a portion naturally separates from the fuel film 219 and flows through the bifurcating passage 230 to provide a plurality of concentric flows. The concentric flows 219*a*, 219*b* spinningly converge inwardly, as a result of being directed by the converging portions of the filing surfaces 207, 209 (i.e. converging second portion 222 and converging fourth portion 224 of the nozzle projections 227, 229 respectively), and disperse into atomized droplets 221*a*, 221*b*, as the fuel flows come into contact with the air flows 216, 218, passing through the respective primary and secondary air passageways 203, 204. Providing a plurality of concentric filming surfaces 207, 209 may result in a smaller droplet size and hence better atomization, as compared to the provision of a single filming flow.

In the example shown in the figures, the plurality of bifurcating passages 230 are inclined relative to the radial direction R to facilitate the flow of the fuel 219*a*. An angle between a downstream wall 230*b* of the bifurcating passages 230 and the axial direction is acute (i.e. the bifurcating passages 230 are downstream inclined).

In the example shown in the Figures, the fuel film 219*a* is spinning in a clockwise direction 240, while the fuel film 219*b* is spinning in a counterclockwise direction 241. The air 216 is also spinning in a clockwise direction 242, while the air 218 is spinning in a counter clockwise direction 243. Having the fuel films 219*a*, 219*b* spinning in opposite directions from the air may enhance the shearing and atomisation of the fuel. It is contemplated that the air 216, 218 and fuel films 219*a*, 219*b* may be spinning in various combinations of directions relative from each other. Some of the fuel and air may also not be spinning.

The above flow splitter may allow producing exiting fuel films with a reduced thickness with minimal redesign of the fuel nozzle, avoiding the complications of staging and multiple fuel passages.

The above description is meant to be exemplary only, and one skilled in the art will recognize that changes may be made to the embodiments described without departing from the scope of the invention disclosed. For example, while a single bifurcation through the bifurcating passage 130/230 is shown in the figures, it is contemplated that more than one bifurcation would split the fuel films 119/219 into more (and possibly thinner) films. It is also contemplated that the fuel nozzle 100/200 could include another air passageway, such as disposed between the first fuel passageway 106/206 and the second fuel passageway 132/232 so as to shear in between the fuels films 119*a*, 119*b*/219*a*,219*b*. Similarly, the nozzle 100/200 could include a variety of bifurcating passages 130/230. Various shapes, number and disposition of the bifurcating passages 130/230 is contemplated. For example, the fuel nozzle 100/200 could have more than one circumferential array of bifurcating passages 130/230. The bifurcating passages 130/230 could be axially aligned or interspaced. The size and number and configuration of the bifurcating passages need not each be identical, and passages 130/230 for example may be provided to obtain the fuel film 119*a*/219*a* of a desired thickness. In another example, a desired thickness could be half of a thickness of the fuel film 119/219. In any case, the bifurcating passages 130/230 may not redirect all the fuel 119/219, but only a substantive portion 119*a*/219*a* to enable thinning of the fuel films 119*a*, 119*b*/219*a*, 219*b* relative to the fuel film 119/219. Other modifications which fall within the scope of the present invention will be apparent to those skilled in the art, in light of a review of this disclosure, and such modifications are intended to fall within the appended claims.

The invention claimed is:

1. A method for delivering fuel from a fuel nozzle of a combustor of a gas turbine engine, the method comprising:

directing a core air flow through a primary air passage of the fuel nozzle, the primary air passage extending centrally within the fuel nozzle and terminating at an exit located at a downstream end of the fuel nozzle;

directing fuel from a fuel source through a flow splitter to provide at least two concentric fuel flows, the flow splitter disposed downstream of the exit of the primary air passage;

filming the at least two concentric fuel flows on concentrically arranged and radially inwardly facing filming surfaces disposed downstream of the flow splitter; and atomizing the at least two concentric fuel flows into the core air flow exiting the primary air passage.

2. The method of claim 1, further comprising imparting a momentum to the pressurised fuel before filming the at least two concentric fuel flows; and directing the fuel comprises directing a portion of the fuel toward the flow splitter by the action of a tangential component of a velocity of the fuel.

3. The method of claim 1, wherein directing the fuel through the flow splitter comprises directing a portion of the fuel through a plurality of bifurcating passages disposed radially outwardly of a first fuel passageway and communicating with a second fuel passageway, the first fuel passageway include one of the filming surfaces and the second fuel passageway include the other one of the filming surfaces.

4. The method of claim 3, further comprising forming the first and second fuel passageways to be annular.

5. The method of claim 1, wherein the filming surfaces form a plurality of concentrically arranged nozzle tip projections disposed at the downstream end of the fuel nozzle.

6. The method of claim 1, further comprising providing the filming surfaces radially outwardly of the primary air passage.

7. The method of claim 1, further comprising forming the filming surfaces as frustoconical surfaces that converge radially toward a downstream annular edge of a tip of the fuel nozzle at the downstream end thereof.

8. The method of claim 1, further comprising directing air through a secondary air passage concentrically defined radially outwardly of the primary air passage, the filming surfaces being disposed radially between the primary air passage and the secondary air passage.

* * * * *